United States Patent [19]

Lucky

[11] Patent Number: 4,745,905

[45] Date of Patent: May 24, 1988

[54] UTENSIL-HOLDER

[76] Inventor: Lloyd P. Lucky, P.O. Box 670803, Chugiak, Ak. 99567

[21] Appl. No.: 75,275

[22] Filed: Jul. 20, 1987

Related U.S. Application Data

[63] Continuation of Ser. No. 798,274, Nov. 15, 1985, abandoned, which is a continuation-in-part of Ser. No. 696,292, Mar. 1, 1985, Pat. No. 4,638,786.

[51] Int. Cl.[4] ..... F24C 15/30

[52] U.S. Cl. ..... 126/24; 126/211

[58] Field of Search ..... 126/24, 27, 218, 211, 126/214 C, 214 D, 215; 248/153, 154, 163.1; 220/401, 19; 99/484, 645

[56] References Cited

U.S. PATENT DOCUMENTS

| | | | |
|---|---|---|---|
| 702,489 | 6/1902 | Scherer | 126/215 X |
| 1,645,466 | 10/1927 | Westlake . | |
| 1,800,109 | 4/1931 | Selig | 126/24 X |
| 2,493,043 | 1/1950 | Stipsky | 126/24 X |
| 2,532,461 | 12/1950 | Reeves | 126/214 C |
| 2,565,694 | 8/1951 | Little | 126/211 X |
| 2,693,176 | 11/1954 | Spiers et al. . | |
| 3,198,189 | 8/1965 | Oatley | 126/211 X |
| 3,423,708 | 1/1969 | Christian . | |

*Primary Examiner*—Randall L. Green

*Attorney, Agent, or Firm*—Griffin, Branigan, & Butler

[57] ABSTRACT

A utensil holder (10) has a first ring (12) having securing means therein that are placed on a cooking surface, such as a stove top or grill, surrounding a heat source. A second ring (20) is spaced a predetermined distance above the first ring (12) by a plurality of support means (28,30). A cooking utensil is placed inside of the holder (10) and a plurality of adjustment means (33) are adjusted until they contact the cooking utensil. The cooking utensil is thus held firmly on the cooking surface. Extension pins (40) extend above the second ring (20) to prevent pot lids from sliding off; and, joinder bars (45) coact with the extension pins (40) to fasten two such utensil-holders together.

2 Claims, 3 Drawing Sheets

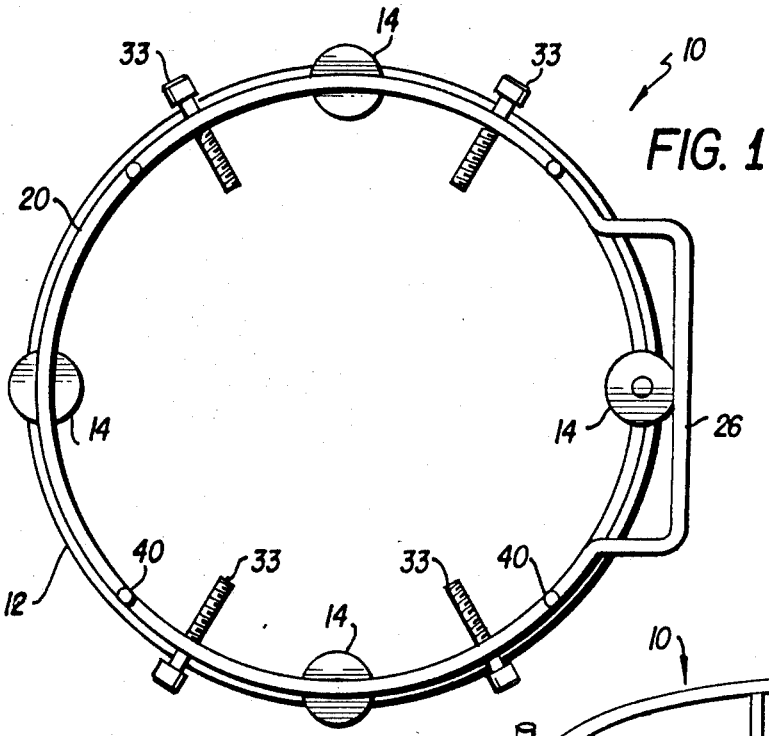
FIG. 1
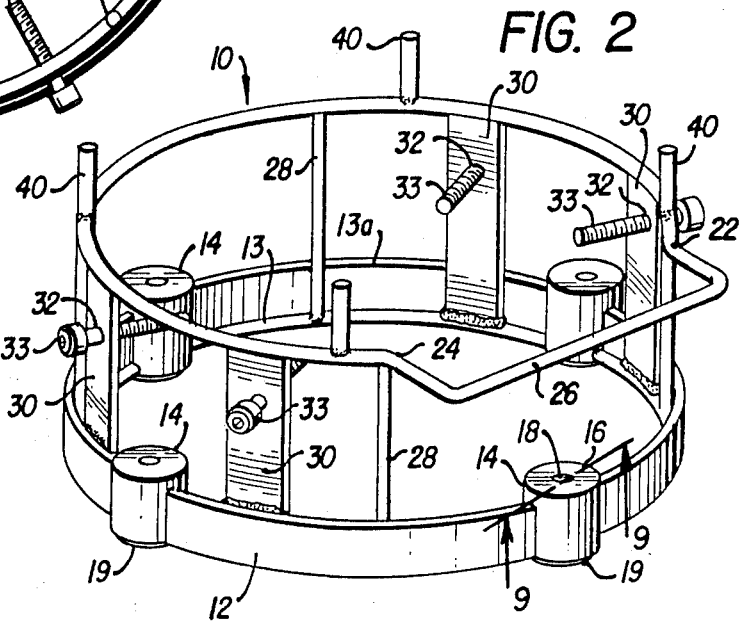
FIG. 2
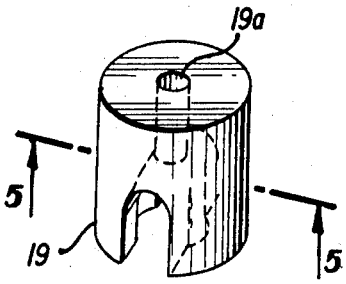
FIG. 3
FIG. 4
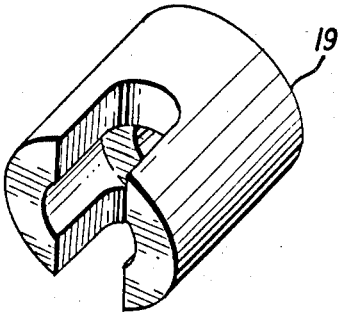
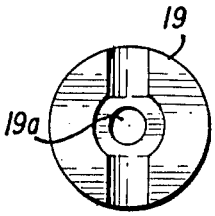
FIG. 5
FIG. 6
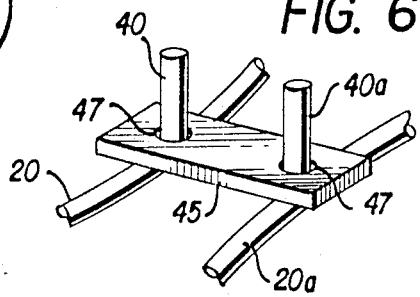

UTENSIL-HOLDER

This is a continuation of application Ser. No. 798,274 filed Nov. 15, 1985, abandoned, which is a continuation-in-part of copending application Ser. No. 696,292 filed on Mar. 1, 1985 and entitled "Magnetic Utensil-Holder", now U.S. Pat No. 4,638,786.

BACKGROUND OF THE INVENTION

The invention relates to a utensil-holder for supporting a cooking utensil on a cooking surface. In this respect, cook stoves on moving vehicles are often bounced about and, during stormy weather seagoing vessels are often tossed at sea. Hence, in such instances, it is difficult to cook as the pots and pans placed on a stove top or grill tend to fall. Moreover, cooks in such instances are often severely burned by the contents of cook pots and the like. Hence, it is important to be sure that such utensils do not move about on such stoves or grills. Accordingly, the instant invention provides a utensil holder that securely holds a cooking utensil, such as a pot, on the cooking surface during such bouncing and turbulence. In this manner the contents of the utensils are retained therein and the attending cooks are not burned.

U.S. Pat. No. 3,198,189 to Oatley discloses a safety device for cooker hobs employing a ring adapted to closely encircle a pan. Such a device cannot accommodate various pan sizes.

U.S. Pat. No. 3,423,708 to Christian discloses a magnetic holder for pots and pans comprising a pair of magnetic sheets having a concave edge. One sheet is placed on each side of the pot with the concave edge facing inwardly to engage the periphery of the pot. Such a holder, however, is not satisfactory for stove tops having a grate over the cooking area as the holder may not be in proper engagement with the pot. The present invention overcomes these problems by providing a magnetic utensil-holder that does not require significant modifications of the stove with which it is to be used.

U.S. Pat. No. 2,693,176 to Spiers et al. discloses a self-leveling cooking device. A pair of standards 10 and 12 are detachably mounted upon a flat surface, such as that indicated at 14 by securing means such as screws 16. The flat surface 14 may be a stove top. Pot holder 30 is pivotably mounted to the standards 10 and 12 so as to keep pots 38 held therein level.

U.S. Pat. No. 3,515,116 to Finnstrand discloses a utensil holder. Gallery stove 10 has a pair of utensil holders 11,12 attached to the base plate of the stove top by means of a horizontal flange 15*a* and a plurality of screws. Arms 13,14 are adjusted to surround the cooking utensil.

U.S. Pat. No. 1,645,466 to Westlake discloses a stove tong attached to a stove-top A. Stove tongs on base-plate B may be attached and removed from the top of the stove by means of screw bolts f,f as occasion requires.

In view of the foregoing, it is an object of the present invention to create an improved utensil-holder that is simple to manufacture, but still protects the cook from burns or other injury by preventing the utensil from sliding off of its burner.

An advantage of the invention is that its non magnetic embodiments may be used with stove tops upon which magnetic securing means will not operate.

Another advantage of the present invention is that it may be easily removed from the stove top when not needed.

Another advantage of the present invention is that it is capable of accommodating various cooking utensil sizes. Moreover, several devices of the invention can be hooked together so that they can assist each other in maintaining stability; and, one embodiment of the invention is operative to also prevent accompanying pot lids from sliding off.

SUMMARY

A utensil-holder has a first ring having securing means therein that are placed on a cooking surface, such as a stove top or grill, surrounding a heat source. A second ring is spaced a predetermined distance above the first ring by a plurality of supports. A cooking utensil is placed inside of the holder and a plurality of adjustment means are adjusted until they contact the cooking utensil. The cooking utensil is thus held firmly on the cooking surface and can be adjusted to accommodate different sizes of utensils Additional protrusions from the second ring project upwardly to prevent accompanying pot lids from sliding off and also provide a means for coacting with a joinder or fastening bar for fastening several of the utensil-holders together.

BRIEF DESCRIPTION OF THE DRAWINGS

FIG. 1 is a top view of a magnetic utensil-holder of the invention;

FIG. 2 is a perspective view of the utensil-holder of the invention;

FIG. 3 is a perspective view of one side and top of a magnet used with the devices of FIGS. 1 and 2;

FIG. 4 is a perspective view of one side and bottom of the magnet of FIG. 3;

FIG. 5 is a cross-sectional view of the FIG. 5 magnet along lines 5—5;

FIG. 6 is a perspective view of a joinder bar for use with two or more of the utensil holders of the invention;

DETAILED DESCRIPTION OF THE DRAWINGS

Figure 7:
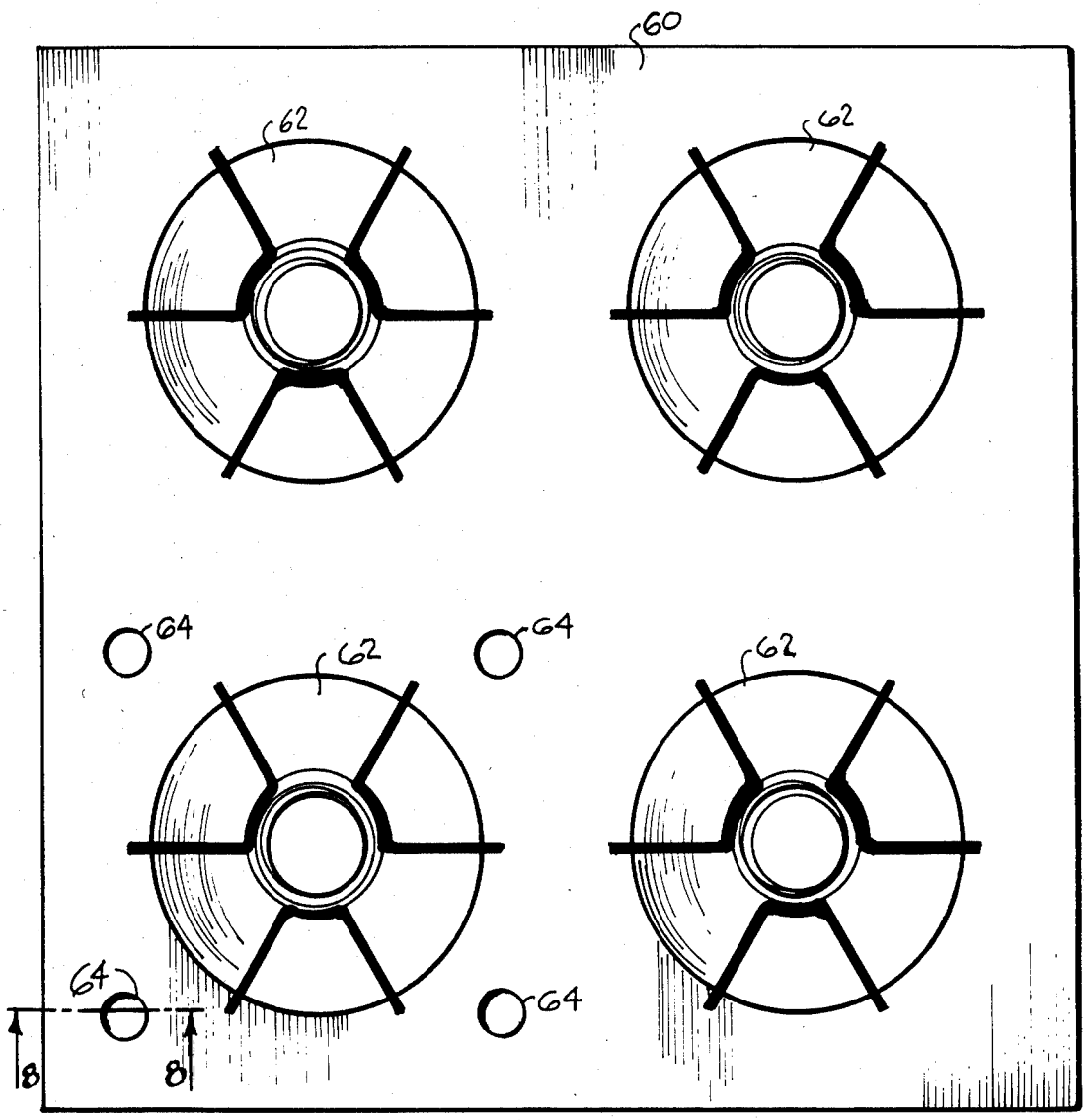
FIG. 7 is a top view of a non-magnetic cooking surface which has been modified to include a plurality of threaded or other holes.

A magnetic utensil holder 10 is manufactured from a material capable of withstanding the heat produced by a cooking surface, such as a stove top or grill. One such suitable material is stainless steel.

The magnetic utensil holder 10 comprises a substantially circular first ring 12, a substantially circular second ring 20 having a handle 26, and a plurality of thin and wide support means 28 and 30, respectively, to support the second ring 20 a predetermined distance above the first ring 12.

The first ring 12 is a compound element comprised of a rounded circular rod 13 and a circular bar 13*a* affixed thereto. The ring 12 has a plurality of magnetic securing means comprising substantially circular cylinders 14 attached to the ring. For convenience only four such cylinders are illustrated, but six or more have been successfully used and five are presently preferable.

Each cylinder 14 has a threaded hole 18 and an open bottom. Housed within each cylinder 14 is a magnet 19. Each such magnet has an inverted U-shape (FIGS. 3–5) with a hole 19*a* through its center. Each magnet 19 is inserted into one of the cylinders 14 and secured in place by a screw (not shown) which goes through the hole 19*a* of the magnet and is screwed into threaded hole 18 of cylinder 14. The magnets are slightly longer than the length of the cylinder so that the magnets slightly protrude from the open end of the cylinder as indicated in FIG. 2.

The second ring 20 is spaced a predetermined distance above the first ring 12 by a plurality of thin support means 28 and wide support means 30. Each wide support includes a threaded hole 32 to accept an adjustment means 33, such as a screw. These screws 33 are used to adapt the holder 10 to a variety of different sized utensils. In this respect, by use of the screws 33 pots of $2\frac{3}{4}$ quarts, $3\frac{3}{4}$ quarts and $4\frac{1}{2}$ quarts, for example, can be used in a single magnetic utensil-holder.

The second ring 20, which is also substantially circular, has a first end 22 and a second end 24. Handle means 26 are attached to the two ends 22 and 24 as shown with a suitable bonding means, such as by welding.

Atop each of the wide supports 30 are extension pins 40 which project upwardly a desired distance such as $1\frac{1}{2}''$ or so and serve to prevent pot lids from sliding off of utensils located within the utensil holder. In this manner it is not necessary to use the customary wires or cables to fasten pot lids in place; and, moreover, the use of these extension pins makes it easier and safer for cooks to obtain access to the contents of the pots. These extension pins are also operative in combination with supplemental joining or fastening bars 45 (FIG. 6) to fasten two or more utensil-holders together. That is, elongated holes 47 in the supplemental fastening bar permit it to be placed over an extension pin 40 on a first utensil holder of the invention and a second extension pin 40*a* on a second utensil holder of the invention. In this manner two or more utensil holders can be fastened together on a grill top, for example, to assist each other by broadening the effective fastening perimenter on the grill.

Figure 9:
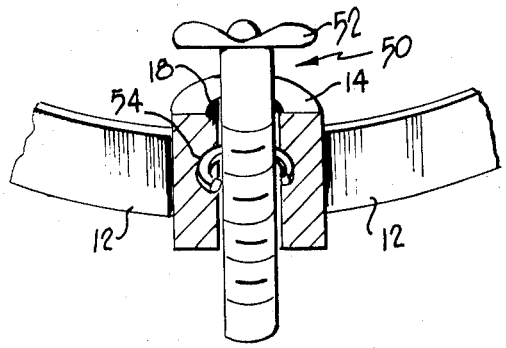
FIG. 9 is a perspective, partially-sectional view of FIG. 2 along lines 9—9, but with a securing means in place; and, FIG. 10 is a perspective view of another embodiment of the invention.

In another embodiment, the utensil-holder functions with non-magnetic surfaces. In place of magnet 19, a screw assembly-securing means 50 (FIG. 9) is inserted into cylinder 14. This screw assembly comprises a screw, such as a wing-screw 52, and a threaded retaining washer 54. Wing-screw 52 is placed through hole 18 of cylinder 14 as shown in FIG. 9. Retaining washer 54 is then threaded over the screw 52 inside the cylinder 14. The retaining washer functions to prevent loss of the screw 52 when the utensil holder is removed from the cooking surface, such as when it is being stored.

Figure 8:
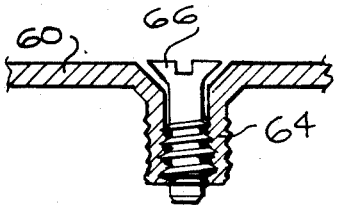
FIG. 8 is a partial sectional view of FIG. 7 along lines 8—8, but having a screw in place.

A cooking surface must be slightly modified to accept the utensil-holder embodiment of FIG. 9. In this respect, FIG. 7 shows a cooking surface 60 having four burners 62. A plurality of threaded holes 64, corresponding to the number of cylinders 14 on the utensil-holder 10 are placed in the cooking surface 60. As indicated in FIG. 8, the threaded holes 64 are tapered at their upper portions for reasons to be disclosed shortly. The surface is now prepared to receive the utensil holder.

In use, the magnetic utensil-holder of FIG. 2 is placed on a cooking surface, such as a stove top or grill, in such a manner that the heat of the stove or grill is within the area defined by the holder. The magnets 19 on the first ring are attracted to the metal of the stove top or grill, creating a fixture that does not easily move. A cooking utensil, such as a pot is placed in the magnetic utensil holder 10 and the adjustment means 33 are adjusted until they make contact with the pot. In this manner, movement of the vehicle will not cause the pot to shift its position with respect to the cook top. When one is finished cooking, the pot is removed and the magnetic utensil-holder 10 is lifted by its handle 26, which will be at a lower temperature than the rest of the holder due to its distance away from the direct heat source of the cooking surface.

The magnetic utensil-holder will not operate on a non-magnetic attracting surface. In this situation, one of the alternate embodiments is employed. The utensil holder having the screw embodiment of FIG. 9, for example, is placed on the modified cooking surface so that the screw assembly 50 is aligned with tapped holes 64. The screws 52 are then tightened until the utensil-holder is firmly affixed to the cooking surface. Cooking utensils are then placed in the holder as described in the prior embodiment. When one is finished cooking, the screws 52 are loosened and the utensil-holder is lifted by its handle 26. To eliminate dirt and debris from collecting in the holes, tapered screws 66 are screwed into the holes 64. When the screws 66 are in place, their heads are flush with the cooking surface 60.

Figure 10:
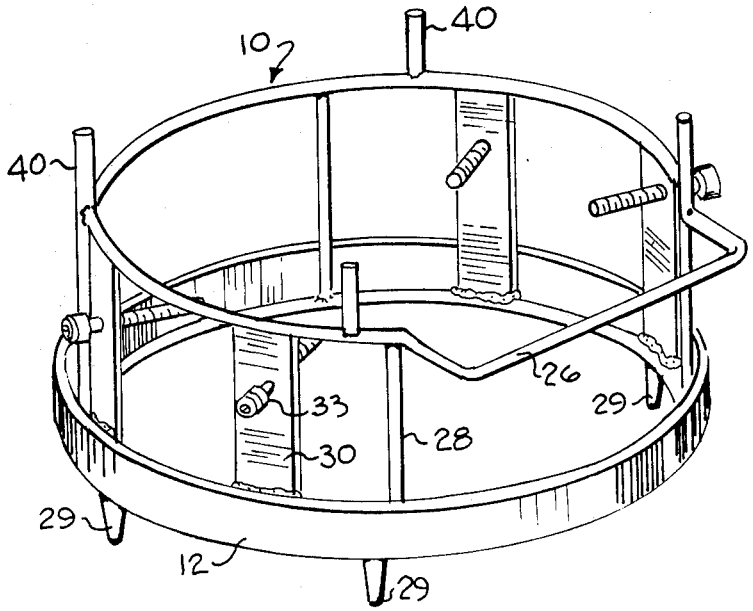

Construction of the utensil-holder for use with non-magnetic surfaces may be simplified by the elimination of cylinders 14. In their place, attachment pins 29 extend below the first ring 12 so as to fit into the holes 64 placed in the cooking surface 60. Attachment pins 29 may be an extension of support means 28 as shown in FIG. 10 and, in a preferred embodiment, extent about $1\frac{1}{3}''$ below ring 12. As with the previously described non-magnetic utensil-holder, tapered screws 66 may be screwed into holes 64 when the utensil-holder is not being used so as to create a cooking surface without voids.

While the invention has been particularly shown and described with reference to the preferred embodiments thereof, it will be understood by those skilled in the art that various alterations in form and detail may be made therein without departing from the spirit and scope of the invention. For example, slots may be made in the compound ring 12 to accommodate grates or the like that may be used on a stove. Similarly, the non-magnetic utensil-holder may also be used with a suitably modified magnetically attractable cooking surface.

The embodiments of the invention in which an exclusive property or privilege is claimed are defined as follows:

1. A utensil-holder for preventing movement of a cooking utensil placed on a cooking surface, said cooking surface having holes, comprising:

(a) frame means including:

(i) first ring means having a substantially circular shape;

(ii) second ring means having a substantially circular shape;

(iii) means for supporting said second ring means a predetermined distance above said first ring means;

(iv) securing means for securing said first ring means to said cooking surface, said securing means including a plurality of attachment means extending below said first ring means, said attachment means being operative to engage said holes in said cooking surface; and, (b) adjustment means in said frame means for adjusting said holder to accomodate various utensil sizes; and, (c) a plurality of extension pins extending upwardly from said frame means for preventing lids on said utensils from sliding off during cooking.

2. A utensil holder as recited in claim 1 including fastening bar means for selectively engaging one of said extension pins and including means for selectively engaging an extension pin on a second such utensil-holder located adjacent the first utensil-holder.

* * * * *